United States Patent [19]

Clark

[11] Patent Number: 4,512,044

[45] Date of Patent: Apr. 23, 1985

[54] PORTABLE SHOWER AND BATH MAT

[76] Inventor: John T. M. Clark, 1722 Shorelane, R.R. 3, Stayner, Ontario, Canada, L0M 1S0

[21] Appl. No.: 250,161

[22] Filed: Apr. 2, 1981

[51] Int. Cl.[3] ..... A47K 3/00

[52] U.S. Cl. ..... 4/581; 4/611; 425/131; 425/167

[58] Field of Search ..... 4/580–583, 4/611, 613, 588; D6/209; 428/167, 131, 64, 138, 180; 15/215–217, 238; 296/1 F; 180/90.6; 52/177, 179–181, 606, 607

[56] References Cited

U.S. PATENT DOCUMENTS

| | | | |
|---|---|---|---|
| D. 172,450 | 6/1954 | Timmons | 15/215 X |
| D. 194,449 | 1/1963 | Kraines et al. | D6/209 |
| 1,613,158 | 3/1925 | Brewer | 4/583 |
| 2,055,629 | 10/1935 | Marvin | 4/581 |
| 2,503,174 | 10/1948 | Salvadore | 4/581 |
| 3,091,779 | 6/1963 | Lucas et al. | 4/583 |
| 3,126,978 | 3/1964 | Bergstrom | 428/131 |
| 3,252,293 | 5/1964 | George et al. | 15/581 |
| 3,577,581 | 5/1971 | Stata | 296/1 F |
| 3,605,365 | 9/1971 | Hastings | 429/167 X |
| 3,703,059 | 11/1972 | Kessler | 52/177 |
| 3,802,144 | 4/1974 | Spica | 428/131 X |
| 4,023,220 | 5/1977 | Younker | 4/583 |
| 4,133,481 | 1/1979 | Bennett | 428/180 X |

FOREIGN PATENT DOCUMENTS

| | | | |
|---|---|---|---|
| 131550 | 2/1929 | Switzerland | 4/583 |

OTHER PUBLICATIONS

Starcrest of California, Deluxe Bath Mate, 1980, one page.

*Primary Examiner*—Stephen Marcus

*Attorney, Agent, or Firm*—Mozley, Finlayson, Wedge & Andersen

[57] ABSTRACT

An improved portable shower and bath mat including a non-absorbent mat having a non-slip bottom surface and having a channeled bottom surface and a plurality of drain holes through said pad to permit water to drain through said pad to the channels in the bottom surface of said pad and into the shower or bath drain.

28 Claims, 5 Drawing Figures

PORTABLE SHOWER AND BATH MAT

BACKGROUND OF THE INVENTION

The present invention is an improved portable shower and bath mat which may also be used as a portable drying mat following the bath or shower.

A problem commonly encountered by outdoorsmen is that outdoor bathing facilities are often susceptible to dirt and grit being tracked into the shower area from the outdoors. Such problem exists at public camping facilities and at beaches.

Under these circumstances, a bather is often in the position of having to step into a shower facility having a dirty or sandy floor, and then, after showering and attempting to completely clean the feet, the bather must stand on the dirty or sandy floor to dry. Finally, the bather must place his socks and shoes on after standing on the dirty or sandy floor.

SUMMARY OF THE INVENTION

The object of the present invention is to provide an improved portable shower or bath mat which can serve initially as a shower mat during the shower and which then dries and drains quickly to provide a clean and dry surface on which the bather can stand following the shower.

A further object of the present invention is to provide a portable shower or bath mat which can be easily and compactly carried by an outdoorsman.

An additional object of the present invention is to provide a portable shower or bath mat which is durable and which can be re-used frequently and over a long period of time.

The foregoing objects and still further objects will be understood based upon the following Description of a Preferred Embodiment and Drawings, in which the parts described in the Specification are all shown by like numbered parts in the drawings.

DETAILED DESCRIPTION OF PREFERRED EMBODIMENTS

The following description sets forth a preferred embodiment of the present invention. It will be understood that there are other embodiments of the present invention, and the scope of the present invention is not limited by the following description of a preferred embodiment.

Figure 1:
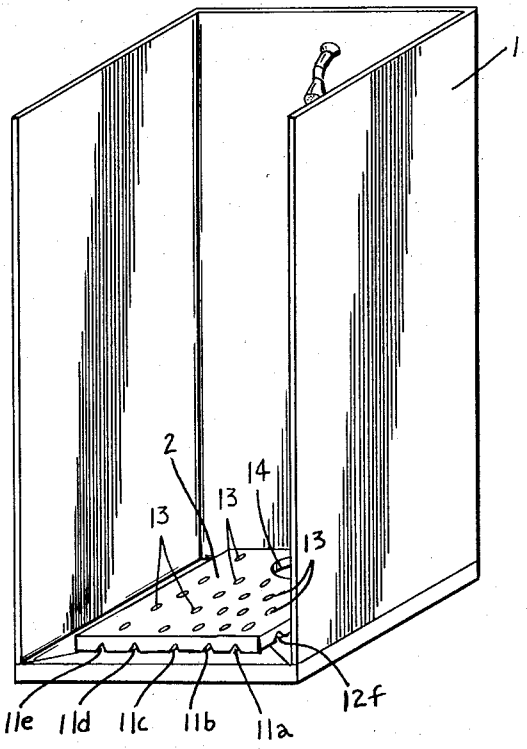
FIG. 1 is a perspective view showing the portable bath or shower mat in use.

The preferred embodiment of the improved portable bath or shower mat is made of high-density styrofoam having a non-slip bottom surface. The mat may be any shape or any size compatible with the floor of a shower stall 1 or the bottom of a bath tub as shown in FIG. 1. For example, the mat may be a rectangular mat as is shown in FIGS. 2 and 3 or it may be a round or oval mat in shape as shown in FIGS. 4 and 5.

The mat 2 or 4 must be of sufficient thickness to insulate the bather's feet from the cold and wetness of the shower or bath floor and also to facilitate the rapid drainage of water from the upper surface of the mat 2 or 4. The mat may also be made from any other durable, substantially rigid, non-absorbent material having a non-slip bottom surface. The mat or pad should also be made from a material which will insulate the bather's feet from a cold shower or bath floor.

Figure 2:
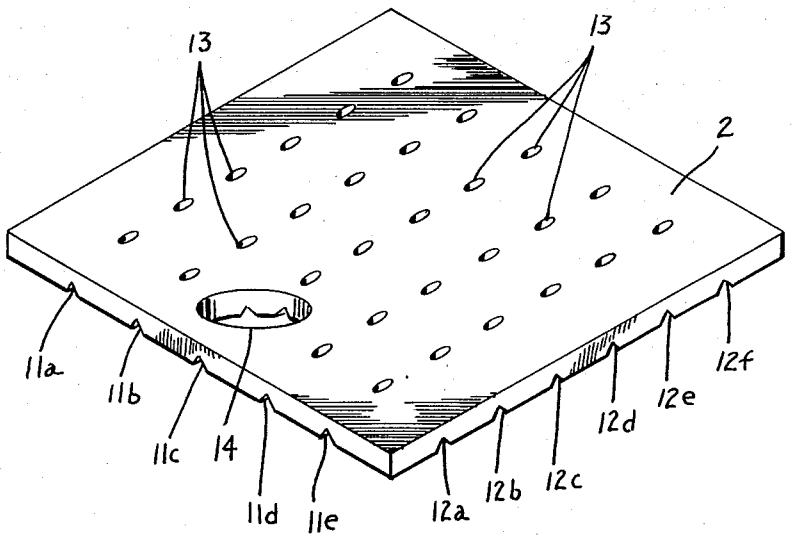
FIG. 2 is a perspective view of the upper surface of an improved portable bath or shower mat in accordance with the present invention.
Figure 3:
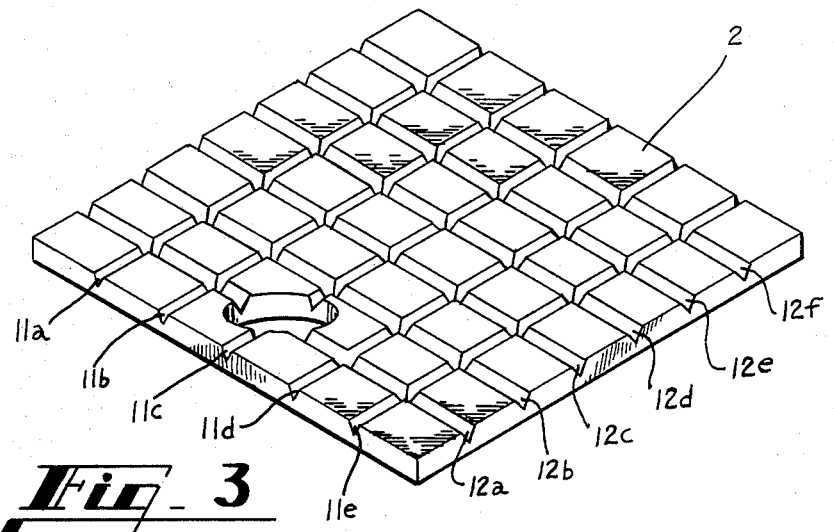
FIG. 3 is a perspective view of the bottom surface of an improved portable bath or shower mat as shown in FIG. 2.

The preferred embodiment shown in FIGS. 2 and 3 includes a channeled bottom surface, having channels 11*a* through 11*e* longitudinally arranged along the width of the bottom surface of the mat, and channels 12*a* through 12*f* transversely arranged along the length of the bottom surface of the mat.

Figure 4:
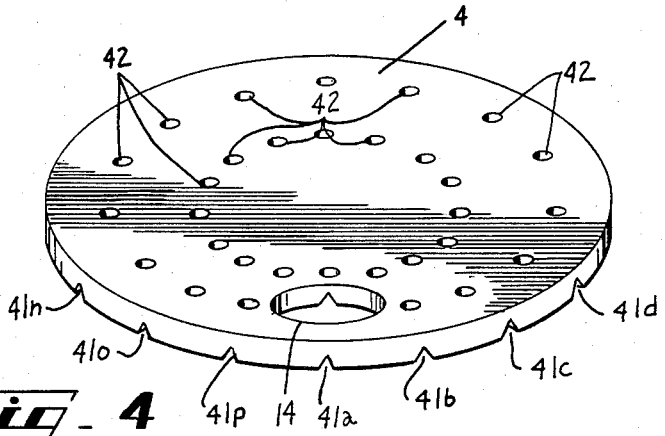
FIG. 4 is a perspective view of the upper surface of a second improved portable bath or shower mat in accordance with the present invention.
Figure 5:
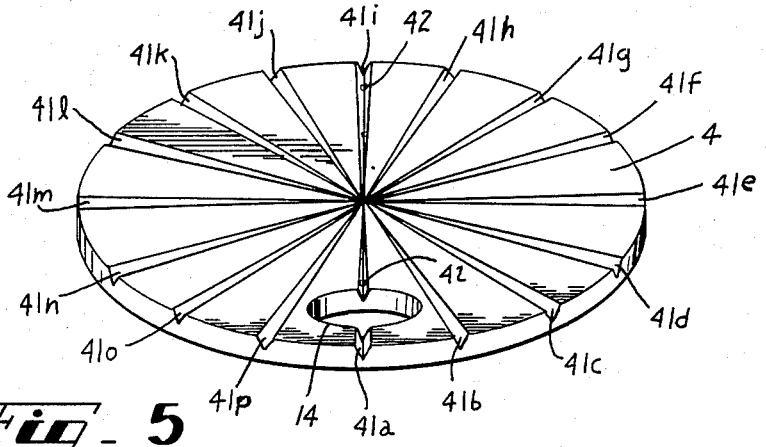
FIG. 5 is a perspective view of the bottom surface of an improved portable bath or shower mat as shown in FIG. 4.

The embodiment shown in FIGS. 4 and 5 also includes a channeled bottom surface, having channels 41*a* through 41*p* arranged radially on the bottom surface of the mat or pad. It will be understood, however, that a mat having a circular or oval shape may also have a plurality of parallel channels arranged as shown in FIG. 3, as opposed to radial channels as shown in FIG. 5.

The mats 2 or 4 may also include a large hole 13 which may be used to carry the mat, hang the mat over a standard shower head for storage when the mat is not in use, and the hole may also be arranged to fit over the drain hole of the shower or bath.

The mat 2 also includes a plurality of drain holes 13 which are situated along the channels 11*a* through 11*e* and a plurality of drain holes 12*a* through 12*g* situated along the channels 12*a* through 12*f*, and the mat 4 includes a plurality of drain holes 42 along the radial channels 41*a* through 41*p*. These drain holes should be sufficient in number to permit water to drain through the mat quickly and then drain away from the mat through the channels in the lower surface of the mat.

In order to use the mat 2 or 4, the bather may place the mat in the shower or bath before bathing and stand on the mat during the shower or bath. Following the bath, the mat will dry quickly providing the bather a clean and dry surface on which to stand while drying and dressing.

It will be understood that the forgoing preferred embodiments are exemplary, and that alternative embodiments can be made without departing from the basic scope of the present invention, which invention is limited solely by the appended claims.

What I claim is:

1. An improved portable shower or bath mat including:

(a) a high density polystyrene pad having an upper surface and also having a channeled bottom surface, wherein at least one of said channels extends to at least one edge of said pad; and (b) said pad further including a plurality of drain holes, including drain holes extending from said upper surface through said pad to said channels in said bottom surface.

2. An improved portable shower or bath mat as claimed in claim 1 wherein said pad includes a first length dimension and includes a second width dimension, and wherein said channels include at least one channel transverse to said length dimension.

3. An improved portable shower or bath mat as claimed in claim 2 wherein said channels include at least one channel longitudinal to said length dimension.

4. An improved portable shower or bath mat as claimed in claim 1 wherein said pad includes a central location and wherein said channels include at least one channel extending radially from said central location.

5. An improved portable shower or bath mat as claimed in claim 1 wherein said channels include a first plurality of parallel channels.

6. An improved portable shower or bath mat as claimed in claim 5 wherein said channels further include a second plurality of parallel channels perpendicularly arranged in relation to said first plurality of parallel channels.

7. An improved portable shower or bath mat including:

(a) a high density polystyrene pad having an upper surface and also having a channeled bottom surface wherein at least one of said channels extends to at least one edge of said pad;

(b) said pad further including a plurality of drain holes extending from said upper surface through said pad to said channels in said bottom surface; and (c) said pad having exterior dimensions and weight suitable for a bather to carry said pad in one hand to said shower or bath.

8. An improved portable shower or bath mat as claimed in claim 7 wherein said pad includes a first length dimension and includes a second width dimension and wherein said channels include at least one channel transverse to said length dimension.

9. An improved portable shower or bath mat as claimed in claim 7 wherein said channels include at least one channel longitudinal to said length dimension.

10. An improved portable shower or bath mat as claimed in claim 7 wherein said pad includes a central location and wherein said channels include at least one channel extending radially from said central location.

11. An improved portable shower or bath mat as claimed in claim 7 wherein said channels include a first plurality of parallel channels.

12. An improved portable shower or bath mat as claimed in claim 11 wherein said channels further include a second plurality of parallel channels angularly arranged in relation to said first plurality of parallel channels.

13. An improved portable shower or bath mat including:

(a) a rectangular high density polystyrene pad having a first length dimension and a second width dimension and further including an upper surface and also including a channeled bottom surface, wherein a first plurality of said channels extend longitudinally from the front of said pad to the rear of said pad, and wherein a second plurality of said channels extend transversely across said pad perpendicularly relative to said first plurality of channels;

(b) said pad further including a plurality of drain holes extending from the upper surface of said pad to said first plurality of channels and to said second plurality of channels and (c) said pad having a length, width, thickness and weight suitable for a bather to carry said pad in one hand to said shower or bath.

14. An improved portable shower or bath mat including:

(a) a circular high density polystyrene pad having an upper surface and also having a channeled bottom surface;

(b) said pad further including a plurality of drain holes extending from the upper surface of said pad through said pad to said channel; and (c) said pad having a diameter, thickness and weight suitable for a bather to carry said pad in one hand to said shower or bath.

15. An improved portable shower or bath mat as claimed in claim 14 wherein said channels include a first plurality of parallel channels.

16. An improved portable shower or bath mat as claimed in claim 15 wherein said channels further include a second plurality of parallel channels angularly arranged in relation to said first plurality of channels.

17. A new method for a bather to insulate the feet from a shower or bath floor by using an improved portable shower or bath mat, including the following steps:

(a) said bather removing all footwear and stepping directly upon an improved portable shower or bath mat, said mat including:

(i) a substantially rigid non-absorbent pad having a channeled bottom surface, wherein at least one of said channels extends to at least one edge of said pad; and (ii) said pad further includes a plurality of drain holes, including drain holes extending from said upper surface through said pad to said channels in said bottom surface; and (b) showering or bathing and then, following said shower or bath, allowing said portable shower or bath mat to drain until dry; and (c) standing upon said shower or bath mat to dry the feet and stepping from said mat directly into any desired footwear after drying the feet.

18. A new method for a bather to insulate the feet from a shower or bath floor by using an improved portable shower or bath mat, including the following steps:

(a) said bather removing all footwear and stepping directly upon an improved portable shower or bath mat, said mat including:

(i) a high density polystyrene pad having, a channeled bottom surface, wherein at least one of said channels extends to at least one edge of said pad; and (ii) said pad further includes a plurality of drain holes, including drain holes extending from said upper surface through said pad to said channels in said bottom surface; and (b) showering or bathing and then, following said shower or bath, allowing said portable shower or bath mat to drain until dry; and (c) standing upon said shower or bath mat to dry the feet and stepping from said mat directly into any desired footwear after drying the feet.

19. An improved method for a bather to insulate the feet or body from a shower or bath floor, wherein said bather is insulated from said floor by standing upon or otherwise being supported by an improved shower or bath mat, said mat including:

(i) a high density polystyrene pad having an upper surface and also having a channeled bottom surface, said bottom surface having at least one first channel; and (ii) said pad further including at least one drain hole extending from said upper surface through said pad to at least one channel in said bottom surface.

20. An improved method for a bather to insulate the feet from a shower or bath floor as claimed in claim 19, wherein said bottom surface of said high density polystyrene pad includes at least one second channel in communication with said first channel and angularly arranged in relation to said first channel.

21. An improved method for a bather to insulate the feet from a shower or bath floor as claimed in claim 19, wherein said high density polystyrene pad includes a first length dimension and includes a second width dimension and wherein said bottom surface of said pad includes at least one channel transverse to said length dimension.

22. An improved method for a bather to insulate the feet from a shower or bath floor as claimed in claim 21, wherein said bottom surface of said high density polystyrene pad includes at least one channel longitudinal to said length dimension.

23. An improved method for a bather to insulate the feet from a shower or bath floor as claimed in claim 18, wherein said high density polystyrene pad includes a first central location and wherein said channel includes at least one channel extending radially from said first central location to at least one edge of said pad.

24. An improved method for a bather to insulate the feet or body from a shower or bath floor, wherein said bather is insulated from said floor by standing upon or otherwise being supported by an improved shower or bath mat, said mat including:

(i) a high-density polystyrene pad having an upper surface and also having a channeled bottom surface, said bottom surface including at least one first channel;

(ii) said pad further including at least one drain hole extending from said upper surface through said pad to at least one channel in said bottom surface; and (ii) said pad having exterior dimensions and weight suitable for a bather to carry said pad in one hand to said shower or bath.

25. An improved method for a bather to insulate the feet from a shower or bath floor as set forth in claim 24, wherein said high-density polystyrene pad of said bottom surface further includes at least one second channel in communication with said first channel and angularly arranged in relation to said first channel.

26. An improved method for a bather to insulate the feet from a shower or bath floor as claimed in claim 24, wherein said high-density polystyrene pad includes a first length dimension and includes a second width dimension, and wherein said bottom surface of said pad includes at least one channel transverse to said length dimension.

27. An improved method for a bather to insulate the feet from a shower or bath floor as claimed in claim 26, wherein said bottom surface of said high-density polystyrene pad further includes at least one channel longitudinal to said length dimension.

28. An improved method for a bather to insulate the feet from a shower or bath floor as claimed in claim 24, wherein said high-density polystyrene pad includes a first central location and wherein said bottom surface of said pad includes at least one channel extending radially from said first central location to at least one edge of said pad.

* * * * *